US005996563A

United States Patent [19]

Liao

[11] Patent Number: 5,996,563

[45] Date of Patent: Dec. 7, 1999

[54] AIR INTAKE DEVICE

[76] Inventor: Jun-Yao Liao, 159, Lane 247, Da Chiao 1st Street, Yong Kang City, Tainan, Taiwan

[21] Appl. No.: 09/116,682

[22] Filed: Jul. 16, 1998

[51] Int. Cl.[6] ..... F02M 23/00

[52] U.S. Cl. ..... 123/587; 123/198 E; 137/526; 251/65

[58] Field of Search ..... 123/574, 587, 123/198 E; 251/65; 137/526, 528

[56] References Cited

U.S. PATENT DOCUMENTS 5,626,112 5/1997 Liao ..... 123/198 E

*Primary Examiner*—Noah Kamen

*Attorney, Agent, or Firm*—Alan Kamrath; Oppenheimer, Wolff & Donnelly, LLP

[57] ABSTRACT

An air intake device has a base seat, a hollow main body disposed on the base seat, and a hollow cover seat disposed on the hollow main body. An intake guide pipe is connected to the connection pipe. A plurality of L-shaped plates are disposed in the hollow cover seat. An upper magnet is disposed in the hollow cover seat. A lower magnet is disposed in the hollow main body. The lower magnet has a taper lower portion. The hollow main body has an upper interior, an inner thread, a lower interior, a lower groove, and an upper groove. A hollow adjustment screw is inserted in the hollow main body. The hollow adjustment screw has a center hole and an annular recess receiving a seal ring. The base seat receives an air cleaner.

1 Claim, 5 Drawing Sheets

AIR INTAKE DEVICE

BACKGROUND OF THE INVENTION

The present invention relates to an air intake device. More particularly, the present invention relates to an air intake device which has two repulsive magnets.

A conventional air intake device can take the air into an engine. A large engine needs a large amount of air. A small engine needs a small amount of air. Therefore, various engines need various air intake devices.

SUMMARY OF THE INVENTION

An object of the present invention is to provide an air intake device which has two repulsive magnets to repulse each other in order to control the amount of the intake air.

Another object of the present invention is to provide an air intake device which has a hollow adjustment screw to adjust a spacing between two repulsive magnets.

Accordingly, an air intake device comprises a base seat, a hollow main body disposed on the base seat, a hollow cover seat disposed on the hollow main body, and a connection pipe connected to the hollow cover seat. The hollow cover seat has two opposite lugs and an inner periphery stepped recess formed in a bottom of the hollow cover seat. Each of the opposite lugs has a threaded round hole. A plurality of L-shaped plates are disposed in the hollow cover seat. An upper magnet is disposed in the hollow cover seat and adjacent to the L-shaped plates. A lower magnet is disposed in an upper portion of the hollow main body. The lower magnet and the upper magnet repel each other. The lower magnet has a taper lower portion. A spacing is defined between the upper magnet and the lower magnet. The hollow main body has an upper interior receiving the lower magnet and a plurality of longitudinal plates matching the L-shaped plates, an inner thread in a middle interior of the hollow main body, a lower interior, a lower groove formed on a bottom end of the hollow main body, an upper groove formed on a top end of the hollow main body, two opposite lower cylinder protrusions, and two opposite upper cylinder protrusions. Each of the opposite lower cylinder protrusions has a threaded circular aperture. Each of the opposite upper cylinder protrusions has a threaded circular hole. Two cross bars are disposed in a lower portion of the hollow cover seat. A hollow adjustment screw is inserted in the hollow main body. A seal ring is disposed between the hollow adjustment screw and the hollow main body to surround the hollow adjustment screw. The hollow adjustment screw has a center hole, and an annular recess receiving the seal ring. A rubber blocking ring is inserted in an upper end of the hollow adjustment screw. The hollow adjustment screw engages with the inner thread of the hollow main body. The lower interior of the hollow main body receives a head portion of the hollow adjustment screw. The base seat has a hollow interior receiving an air cleaner, an opening communicating with the hollow interior, and two opposite lobes. Each of the opposite lobes has a threaded round aperture. The air cleaner comprises a collar matching the opening, and a through hole defined by the collar.

DETAILED DESCRIPTION OF THE INVENTION

Figure 1:
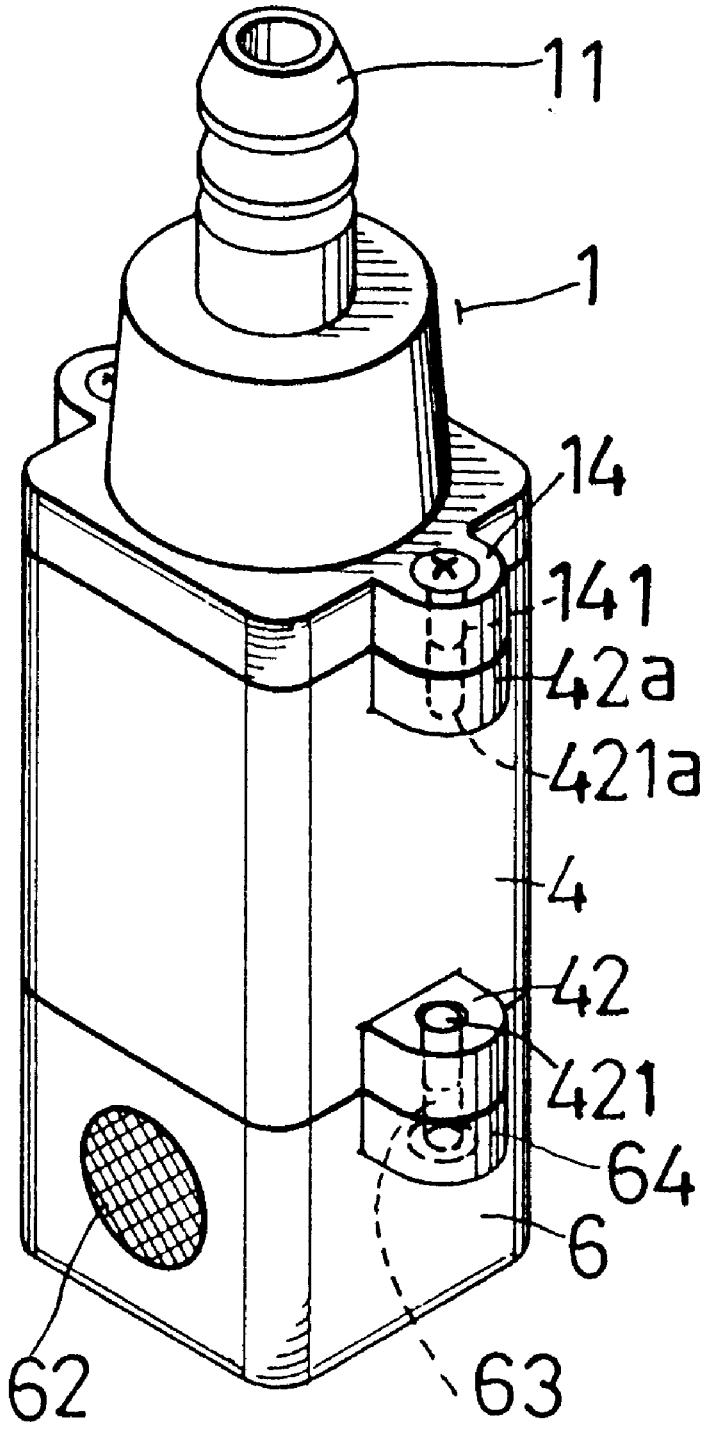
FIG. 1 is a perspective view of an air intake device of a preferred embodiment in accordance with the present invention.
Figure 2A:
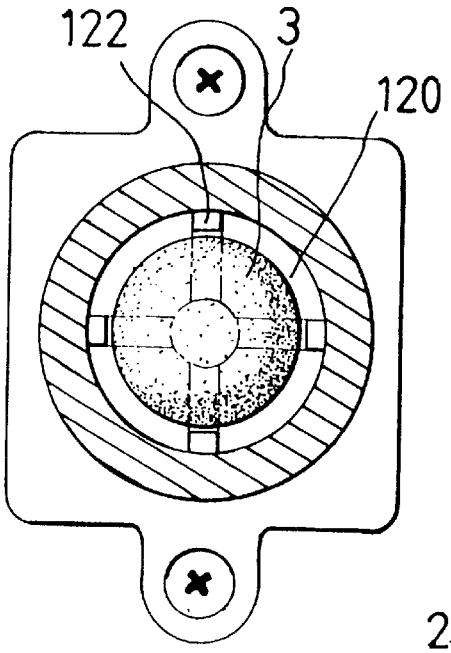
FIG. 2A is a sectional view taken along line 2X—2X in FIG. 2.
Figure 2:
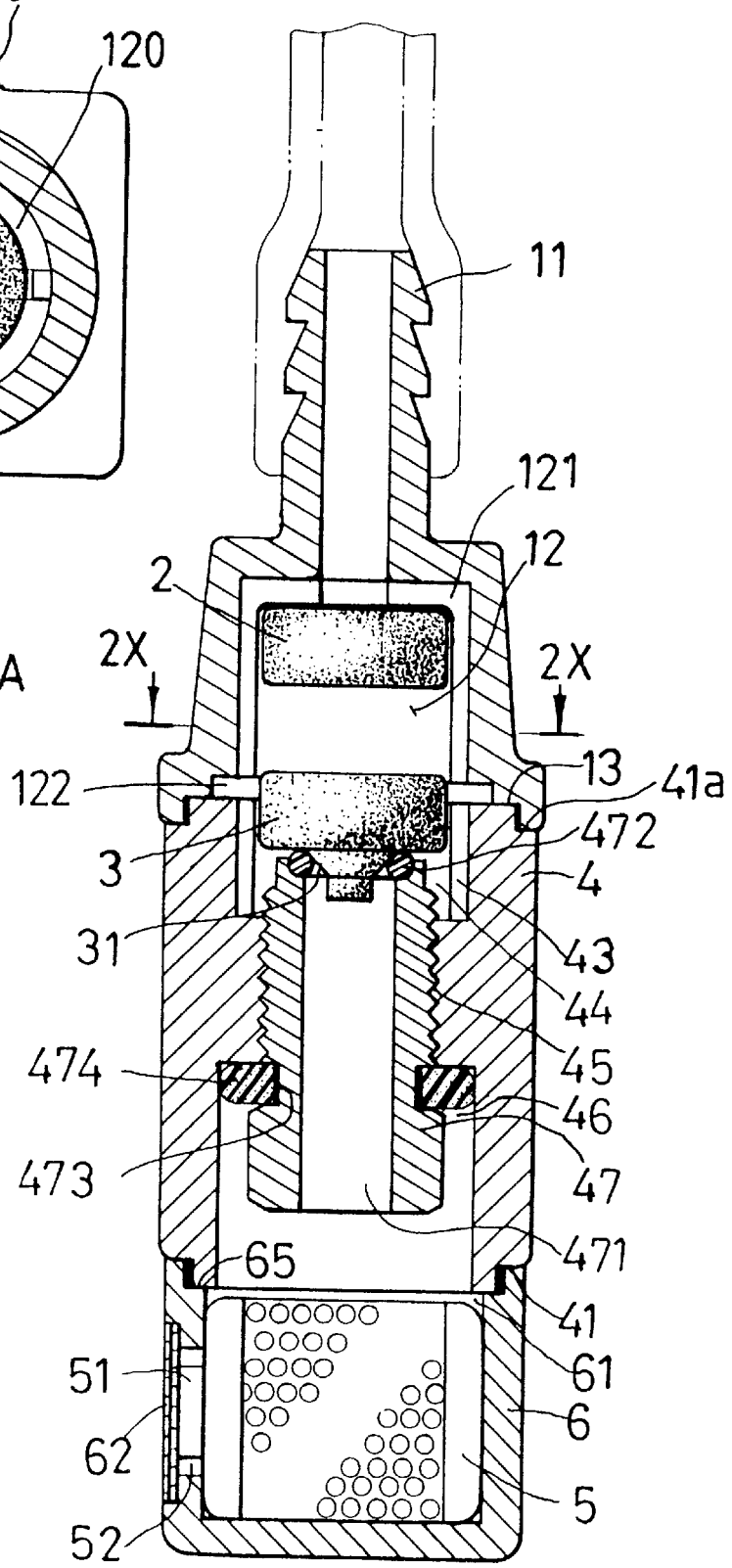
FIG. 2 is a sectional view of an air intake device of a preferred embodiment in accordance with the present invention.
Figure 3:
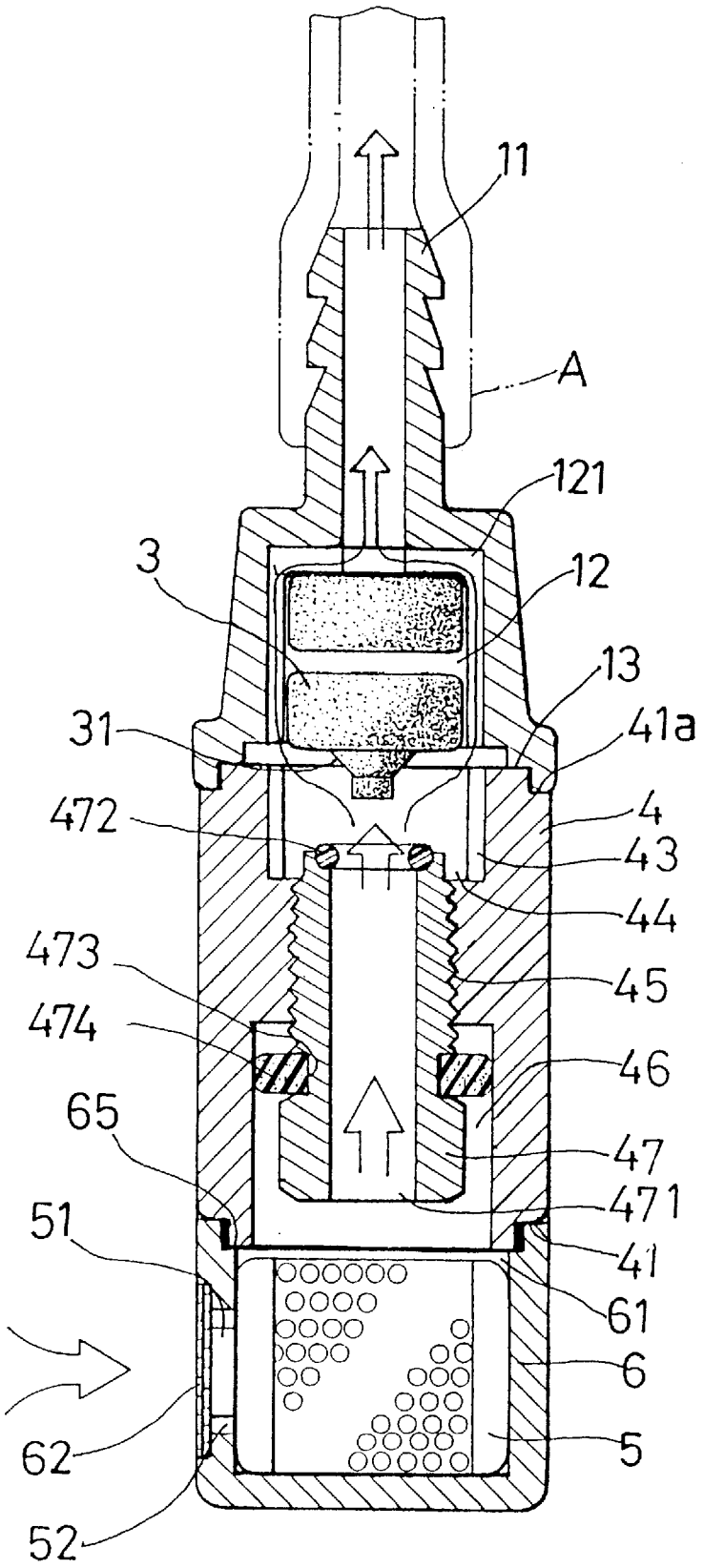
FIG. 3 is a schematic view illustrating an operation of an air intake device of a preferred embodiment in accordance with the present invention.

Referring to FIGS. 1 to 3, an air intake device comprises a base seat 6, a hollow main body 4 disposed on the base seat 6, a hollow cover seat 1 disposed on the hollow main body 4, and a connection pipe 11 connected to the hollow cover seat 1.

The hollow cover seat 1 has two opposite lugs 14 and an inner periphery stepped recess 13 formed in a bottom of the hollow cover seat 1. Each of the opposite lugs 14 has a threaded round hole 141.

A plurality of L-shaped plates 121 are disposed in the hollow cover seat 1. An upper magnet 2 is disposed in the hollow cover seat 1 and adjacent to the L-shaped plates 121.

The upper magnet 2 has a round shape.

A lower magnet 3 is disposed in an upper portion of the hollow main body 4. The lower magnet 3 has a round shape. The lower magnet 3 and the upper magnet 2 repel each other. The lower magnet 3 has a taper lower portion 31. A spacing 12 is defined between the upper magnet 2 and the lower magnet 3.

The hollow main body 4 has an upper interior 44 receiving the lower magnet 3 and a plurality of longitudinal plates 43 matching the L-shaped plates 121, an inner thread 45 in a middle interior of the hollow main body 4, a lower interior 46, a lower groove 41 formed on a bottom end of the hollow main body 4, an upper groove 41*a* formed on a top end of the hollow main body 4, two opposite lower cylinder protrusions 42, and two opposite upper cylinder protrusions 42*a*. Each of the opposite lower cylinder protrusions 42 has a threaded circular aperture 421. Each of the opposite upper cylinder protrusions 42*a* has a threaded circular hole 421*a*. A clearance 120 is defined between the lower magnet 3 and the hollow main body 4. Two cross bars 122 are disposed in a lower portion of the hollow cover seat 1.

A hollow adjustment screw 47 is inserted in the hollow main body 4. A seal ring 474 is disposed between the hollow adjustment screw 47 and the hollow main body 4 to surround the hollow adjustment screw 47. The hollow adjustment screw 47 has a center hole 471, and an annular recess 473 receiving the seal ring 474. A rubber blocking ring 472 is inserted in an upper end of the hollow adjustment screw 47. The hollow adjustment screw 47 engages with the inner thread 45 of the hollow main body 4. The lower interior 46 of the hollow main body 4 receives a head portion of the hollow adjustment screw 47.

The base seat 6 has a hollow interior 61 receiving an air cleaner 5, an opening 62 communicating with the hollow interior 61, and two opposite lobes 64. Each of the opposite lobes 64 has a threaded round aperture 63. The air cleaner 5 comprises a collar 52 matching the opening 62, and a through hole 51 defined by the collar 52.

The taper lower portion 31 of the lower magnet 3 is adjacent to the rubber blocking ring 472.

A first fastener is inserted in the respective threaded round hole 141 and the respective upper cylinder protrusions 42*a* to fasten the hollow cover seat 1 and the hollow main body 4 together. A second fastener is inserted in the respective lower cylinder protrusions 42 and the respective lobe 64 to fasten the hollow main body 4 and the base seat 6 together.

Referring to FIG. 3 again, an intake guide pipe A is connected to the connection pipe 11 and an engine (not shown in the figures). The air passes through the opening 62, the center hole 471, the connection pipe 11, and the intake guide pipe A.

Figure 4:
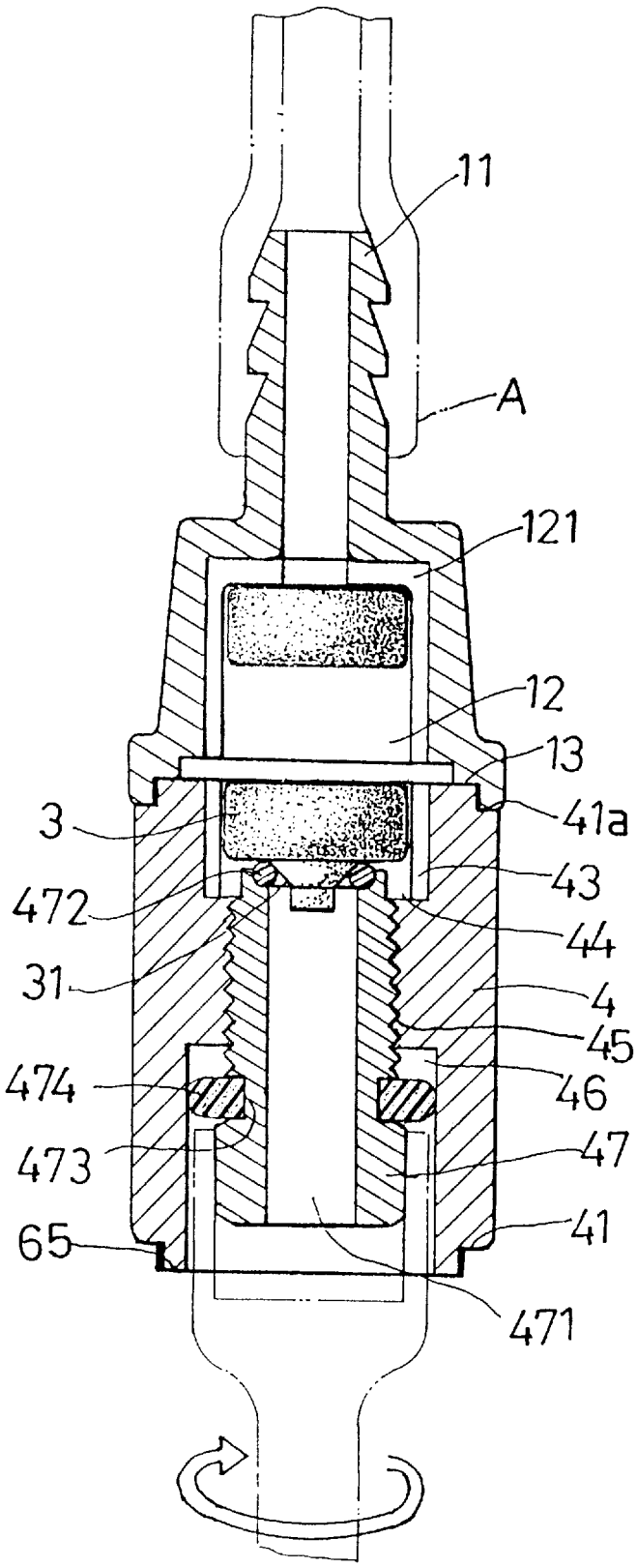
FIG. 4 is a schematic view illustrating a spacing between an upper magnet and a lower magnet is enlarged while a hollow adjustment screw is adjusted.

Referring to FIG. 4, the base seat 6 is detached from the hollow main body 4. The hollow adjustment screw 47 is rotated in order to adjust the width of the spacing 12.

Figure 5:
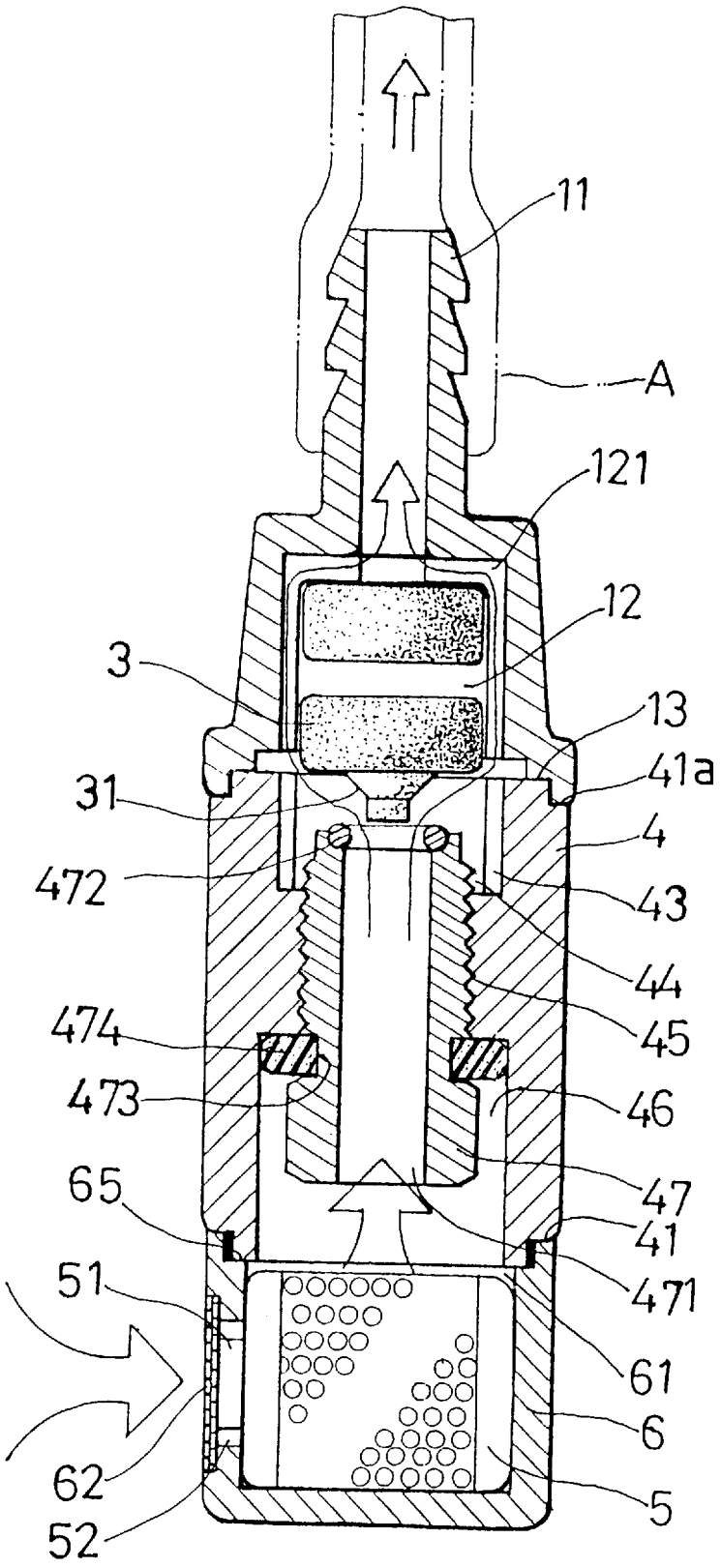
FIG. 5 is a schematic view illustrating an operation of an air intake device while a spacing between an upper magnet and a lower magnet is narrowed.

Referring to FIG. 5, the base seat 6 is mounted on the hollow main body 4 after the hollow adjustment screw 47 is rotated.

The invention is not limited to the above embodiment but various modification thereof may be made. Further, various changes in form and detail may be made without departing from the scope of the invention.

I claim:

1. An air intake device comprises:

a base seat, a hollow main body disposed on the base seat, a hollow cover seat disposed on the hollow main body, a connection pipe connected to the hollow cover seat, the hollow cover seat having two opposite lugs and an inner periphery stepped recess formed in a bottom of the hollow cover seat, each of the opposite lugs having a threaded round hole, a plurality of L-shaped plates disposed in the hollow cover seat, an upper magnet disposed in the hollow cover seat and adjacent to the L-shaped plates, a lower magnet disposed in an upper portion of the hollow main body, the lower magnet and the upper magnet repelling each other, the lower magnet having a taper lower portion, a spacing defined between the upper magnet and the lower magnet, the hollow main body having an upper interior receiving the lower magnet and a plurality of longitudinal plates matching the L-shaped plates, an inner thread in a middle interior of the hollow main body, a lower interior, a lower groove formed on a bottom end of the hollow main body, an upper groove formed on a top end of the hollow main body, two opposite lower cylinder protrusions, and two opposite upper cylinder protrusions, each of the opposite lower cylinder protrusions having a threaded circular aperture, each of the opposite upper cylinder protrusions having a threaded circular hole, two cross bars disposed in a lower portion of the hollow cover seat, a hollow adjustment screw inserted in the hollow main body, a seal ring disposed between the hollow adjustment screw and the hollow main body to surround the hollow adjustment screw, the hollow adjustment screw having a center hole and an annular recess receiving the seal ring, a rubber blocking ring inserted in an upper end of the hollow adjustment screw, the hollow adjustment screw engaging with the inner thread of the hollow main body, the lower interior of the hollow main body receiving a head portion of the hollow adjustment screw, the base seat having a hollow interior receiving an air cleaner, an opening communicating with the hollow interior, and two opposite lobes, each of the opposite lobes having a threaded round aperture, and the air cleaner comprising a collar matching the opening, and a through hole defined by the collar.

* * * * *